United States Patent [19]

Langas et al.

[11] Patent Number: 4,815,182

[45] **Date of Patent: * Mar. 28, 1989**

[54] APPARATUS AND METHOD FOR AUTOMATICALLY SECURING BORDERWIRES ON MATTRESS INNERSPRINGS

[75] Inventors: Arthur Langas, Glenview; Donald B. Ayres, Skokie, both of Ill.

[73] Assignee: Hartco Company, Skokie, Ill.

[ * ] Notice: The portion of the term of this patent subsequent to Feb. 16, 2005 has been disclaimed.

[21] Appl. No.: 120,528

[22] Filed: Nov. 13, 1987

Related U.S. Application Data

[63] Continuation-in-part of Ser. No. 944,561, Dec. 22, 1986, Pat. No. 4,724,590.

[51] Int. Cl.[4] ..... B68G 7/00

[52] U.S. Cl. ..... 29/91; 29/712; 29/564.1; 198/836; 140/3 CA

[58] Field of Search ..... 29/564, 564.1, 564.7, 29/91, 712; 198/458, 836, 817, 339.1; 140/3 CA, 93 D; 267/110

[56] References Cited

U.S. PATENT DOCUMENTS

| | | | |
|---|---|---|---|
| 2,229,605 | 1/1941 | Snyder et al. | 198/836 |
| 2,706,034 | 4/1955 | Russell et al. | 198/836 |
| 2,951,574 | 9/1960 | Craig | 198/836 |
| 4,674,238 | 6/1987 | Suzuki et al. | 198/836 |
| 4,697,318 | 10/1987 | Wickham et al. | 29/564 |

*Primary Examiner*—P. W. Echols

*Attorney, Agent, or Firm*—Wallenstein, Wagner, Hattis & Strampel, Ltd.

[57] ABSTRACT

Apparatus for automatically wrapping clips on the borderwires and coils of a mattress innerspring which includes an adjustable alignment mechanism and adjustable clip wrapping tool mechanism for enabling the apparatus to accommodate borderwires and mattress innersprings of substantially any dimensions.

20 Claims, 4 Drawing Sheets

APPARATUS AND METHOD FOR AUTOMATICALLY SECURING BORDERWIRES ON MATTRESS INNERSPRINGS

This application is a continuation-in-part application of Ser. No. 944,561, filed Dec. 22, 1986, entitled "Apparatus and Method for Automatically Securing Borderwires on Mattress Innersprings" now U.S. Pat. No. 4,724,590 dated Feb. 16, 1988.

TECHNICAL FIELD

The present invention relates to apparatus, and a method, of securing borderwires on mattress innersprings.

BACKGROUND OF THE PRIOR ART

In the manufacture of mattress innersprings, whether they are of the continuous coil or separate coil type, borderwires are secured to the coils along the entire upper and lower periphery of the innersprings to impart integrity and rigidity to the overall structure. Heretofore, the borderwires have been secured on the coils of mattress innersprings by means of a hand-held tool. Exemplary of a hand-held tool which can be used for this purpose is the tool disclosed in U.S. Pat. No. 4,546,528. As shown in the patent, the tool is provided with a pressurized air-actuated reciprocatable blade or plunger for sequentially severing clips from a line of interconnected clips spirally wound in the form of a roll. The tool includes an anvil or forming jaw for cradling the borderwire and the coils which form the mattress innerspring thereby enabling the severed clips to be wrapped on the borderwire and the coils of the innerspring by the blade or plunger. An experienced operator using such a tool can wrap clips on the borderwires and coils at the rate of about one clip per second. In an average day, such an operator can wrap upwards of 30,000 clips with the tool, while less skilled operators will average between 15,000 and 20,000 clips per day. Apart from the worker-fatigue problems encountered in a hand tool type operation for securing borderwires on mattress innersprings, the operator has the added burden of maintaining, with his free hand, the borderwires in proper alignment with relation to the coils of the innerspring while the hand tool which is being held in the other hand of the operator, is wrapping clips on the borderwires and the coils of the innerspring. This is a procedure which requires special training of the operator. It is especially difficult in those instances where the mattress innerspring is to be used for making large-sized mattresses referred to in the trade as king and queen size.

BRIEF SUMMARY OF THE INVENTION

In accordance with the present invention, apparatus has been evolved for automatically securing borderwires on mattress innersprings. The apparatus is capable of increasing production rates by nearly fourfold over that of even the most skilled operator using a hand held tool. What is more, these significant increases in production rates are achieved with minimal labor, and without the need for special operator training. The apparatus is uncomplicated in design and construction to simplify its operation, and, more importantly, to reduce operating and maintenance costs to a minimum.

In brief, the apparatus of the present invention, like the apparatus disclosed in copending application Ser. No. 944,561, filed Dec. 22, 1986, comprises horizontally disposed support means on which upper and lower borderwires and a mattress innerspring are positioned prior to the clip wrapping operation. Also, like the apparatus of said copending application, the apparatus of the present invention incorporates alignment means for the borderwires and the mattress innerspring, and a plurality of clip wrapping tools for simultaneously wrapping clips on the borderwires and the coils of the mattress innerspring. The present invention, in one of its aspects, comprises an extension of the alignment means of the apparatus disclosed in said copending application. In particular, the apparatus of this invention is directed to providing automatically adjustable alignment means which enables the apparatus to be used for securing borderwires on mattress innersprings of substantially any dimensions. Stated differently, the alignment means of the present invention enables the apparatus to be used with equal facility to secure clips on borderwires and mattress innersprings of the type used to make twin, king, and queen sized mattresses. The adjustable alignment means acts both to increase, or decrease, as the case may be, the area of the support means on which the borderwires and the mattress innerspring are placed in stacked relation to one another while at the same time altering the position of the clip wrapping tools to accommodate the dimensions of the mattress innerspring. Like the apparatus of said copending apparatus, the apparatus of the present invention employs stop means and power driven pusher means as elements of the alignment means. Also, as with the apparatus of said copending application, the apparatus of this invention employs coil sensing means for activating the clip wrapping tools as the borderwires and the mattress innerspring are advanced along the support means. In addition, the apparatus of this invention, like the apparatus disclosed in said copending application, comprises borderwire spacer or separator means, control means for the sensing means and the pusher means, and clip feed roll means for the clip wrapping tools. To the extent, therefore, that the apparatus of this invention includes elements in common with the apparatus of said copending application, those elements and their function are incorporated herein by reference.

In accordance with another aspect of the present invention, mattress innerspring transfer means desirably is provided for automatically changing the position and the orientation of the borderwires and the mattress innerspring, after clips have been secured along two of the opposed sides thereof, to enable the borderwires to be secured to the mattress innerspring along the unclipped opposed other two sides thereof. The transfer means may comprise an overhead arrangement having means for grasping and raising the mattress innerspring, while at the time orienting it in relation to the clip wrapping tools of auxiliary clip wrapping apparatus to permit completion of the clip wrapping operation.

The foregoing, and other advantages and features of the present invention, will become more apparent upon reference to the accompanying specification, drawings, and claims.

DETAILED DESCRIPTION OF THE INVENTION

Figure 1:
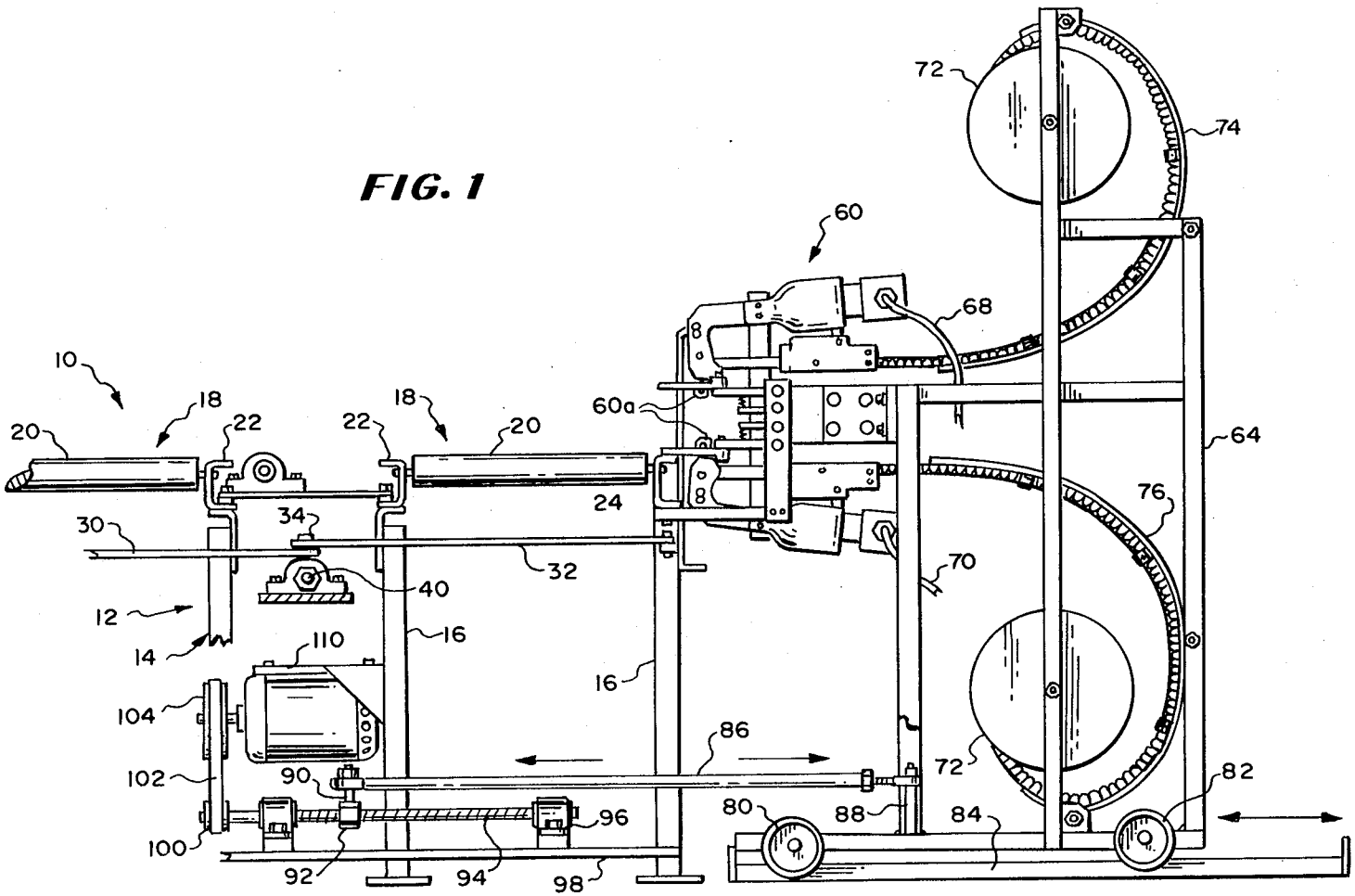
FIG. 1 is a fragmentary end view in elevation of an embodiment of the present invention showing the automatically adjustable alignment means for the borderwires and mattress innerspring, and the clip wrapping tool assembly.
Figure 2:
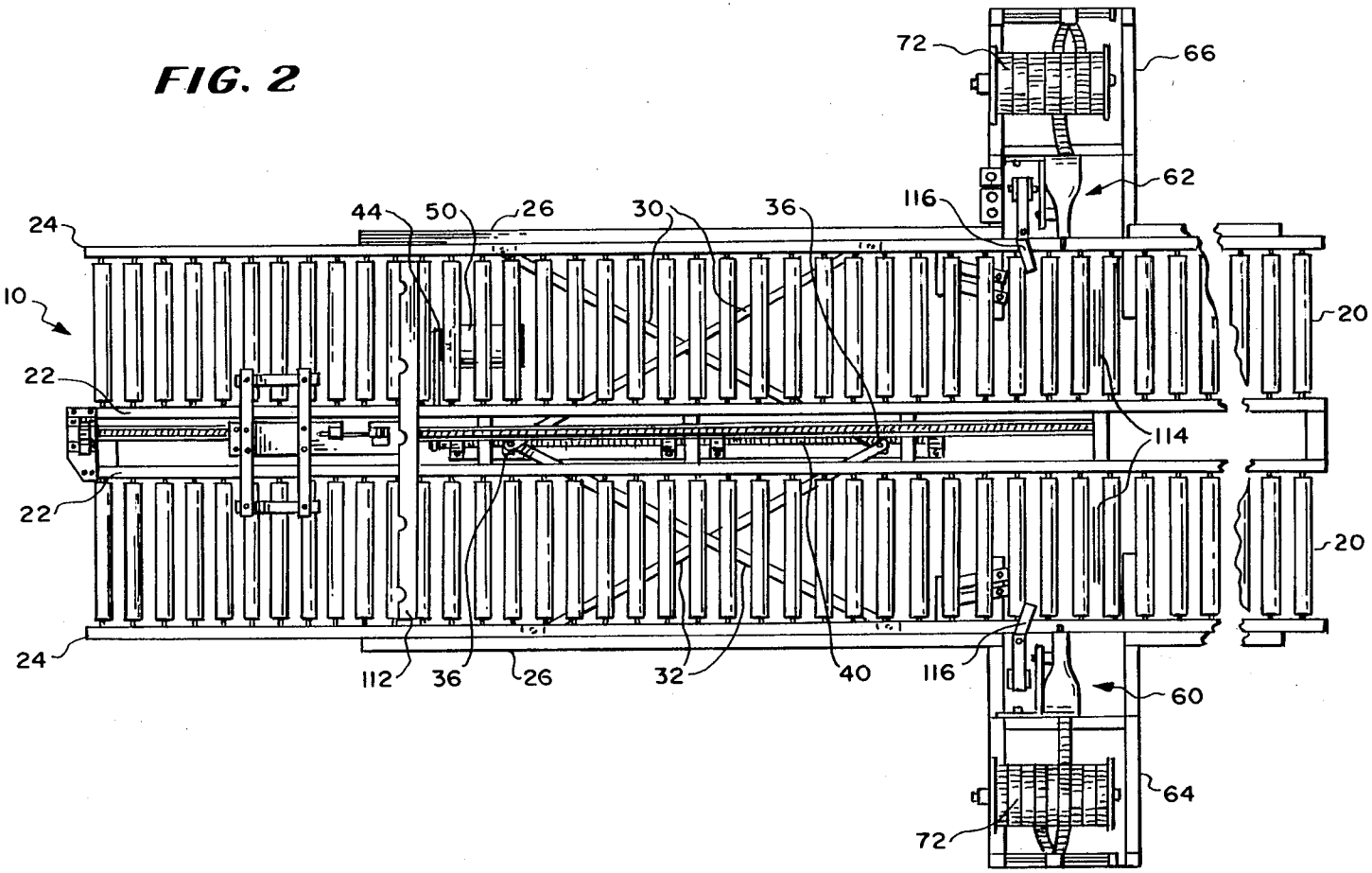
FIG. 2 is a top plan view of said embodiment of the invention.
Figure 3:
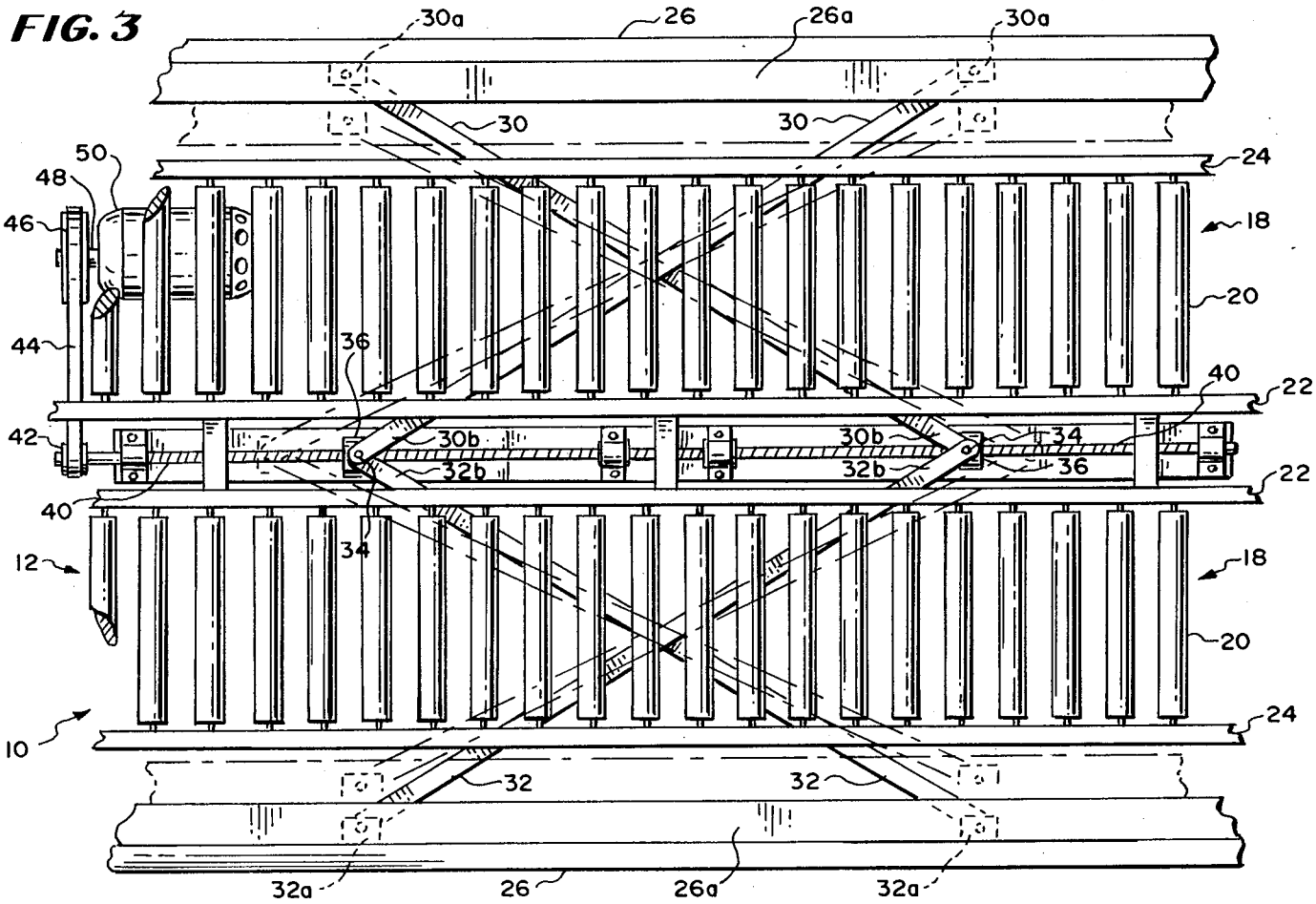
FIG. 3 is a fragmentary top plan view of a portion of said embodiment of the invention showing details of the adjustable alignment means for increasing, or decreasing, the area of the support means to accommodate a mattress innerspring of substantially any dimensions.

Referring, now, in greater detail to FIGS. 1, 2 and 3 of the drawings, the portion of the embodiment of the apparatus illustrated, and designated generally by reference numeral 10, comprises support means 12 in the form of a metal frame 14 having legs 16. Two rows of horizontally disposed conveyor sections 18—18 are arranged in spaced, side-by-side relation on the frame 14, and extend along substantially the entire length of the frame. Each of the conveyor sections 18—18 comprises a plurality of horizontally spaced, freely rotatable rollers 20 journaled for rotation between laterally spaced inner channel members 22—22 and outer channel members 24—24. As illustrated, adjustable guide panels 26—26 are positioned in opposed relation to one another along the outer channel members 24—24. As best shown in FIG. 3, adjustability of the guide panels 2626 toward and away from the outer channel members 24—24 to increase, or decrease, as the case may be, the area between the guide panels 26—26 to accommodate a mattress innerspring positioned on the conveyor sections 18—18, a "scissors" arrangement, comprising two pairs of pivotal arms 30—30 and 32—32, is provided for the panels 26—26. The outer ends 30*a*—30*a* and 32*a*—32*a* of arms 30—30 and 32—32 are each pivotally mounted in spaced apart relation on an inwardly extending flange 26*a* of the guide panels 26—26. The inner ends 30*b*—30*b* and 32*b*—32*b* of the arms 30—30 and 32—32 are pivotally carried on pins 34—34 secured to a pair of traveling nuts 36—36 mounted on a drive screw 40 positioned below and between the spaced conveyor sections 18—18 supported on the frame 14. One end of the drive screw 40 is provided with a pulley 42 which is connected by a belt 44 to a pulley 46 mounted on the drive shaft 48 of a reversible motor 50. Activation of the motor 50 causes the nuts 36—36 to move toward or away from each other depending upon whether rotation of the screw 40 is clockwise or counterclockwise. As shown in FIG. 3, movement of the nuts 36—36 away from each other causes the pivotally arranged arms 30—30 and 32—32 to move in unison, drawing the guide panels 26—26 toward each other.

As best illustrated in FIGS. 1 and 2, two pairs of clip wrapping tools 60 and 62, carried in vertical, spaced relation to one another on movable upright frames 64 and 66, respectively, are positioned on opposite sides of the support means 12 adjacent to the outer channel members 24—24. The orientation of the pairs of tools 60 and 62 with respect to each other, and their construction and operation, are the same as that of the pairs of clip wrapping tools disclosed in copending U.S. patent application Ser. No. 944,561. Thus, each of the tools comprising the pairs 60 and 62 has an anvil or forming jaw (see 60*a* in FIG. 1) for cradling the borderwires and the coils of a mattress innerspring during a clip wrapping sequence. Also, as in the case of the clip wrapping tools disclosed in said copending application, activation of each pair of the tools 60 and 62 is achieved by means of air under pressure conveyed through conduits 68 and 70 in communication with the housing of the tools and a source of pressurized air. Further, in this same connection, each tool comprising the pairs 60 and 62 is provided with a clip feed roll 72. The feed rolls 72 are each advantageously removably supported on the movable frames 64 and 66. The interconnected clips forming the rolls 72 are pulled into the forming jaws of the clip wrapping tools by the clip wrapping action of the tools, and are guided along an upper track 74 and a lower track 76.

The frames 64 and 66 are each provided with two pairs of wheels 80 and 82 which ride on spaced tracks 84. Movement of the frames 64 and 66 along the tracks 84 desirably is achieved by means of a rod 86, one end of which is connected to a bolt 88 secured to the base of the frames 64 and 66, and the other end of which is connected to a bolt 90 secured on a traveling nut 92 carried on a drive screw 94. One end of the screw 94 is journaled for rotation in a support member 96 attached to a crossbar 98 secured to the main frame 14. The other end of the screw 94 is provided with a pulley 100 on which is positioned a belt 102 engaged on a pulley 104 secured to the drive shaft of a reversible motor 110. Operation of the motor 110 for moving the frames 64 and 66, and the motor 50 for moving the guide panels 26—26 is coordinated by common control means such as a switch so that the guide panels 26—26 and the pairs of clip wrapping tools 60 and 62 carried on the frames 64 and 66 will be positioned in proper operative relation with respect to the borderwires and mattress innerspring supported on the conveyor sections 18—18 at the start of the clip wrapping operation.

The apparatus of the present invention, like the apparatus disclosed in said copending application, is provided with a pusher 112 and stop means 114, both of which perform the same functions as the pusher and stop means of the apparatus described in said copending application. Also, like the apparatus disclosed in said application, movable spacer or separator arms 116 are carried on the frames 64 and 66 for maintaining the borderwires in properly spaced relation to the coils of a mattress innerspring as clips are being wrapped on borderwires and the coils at the clip wrapping station of the apparatus.

Figure 4:
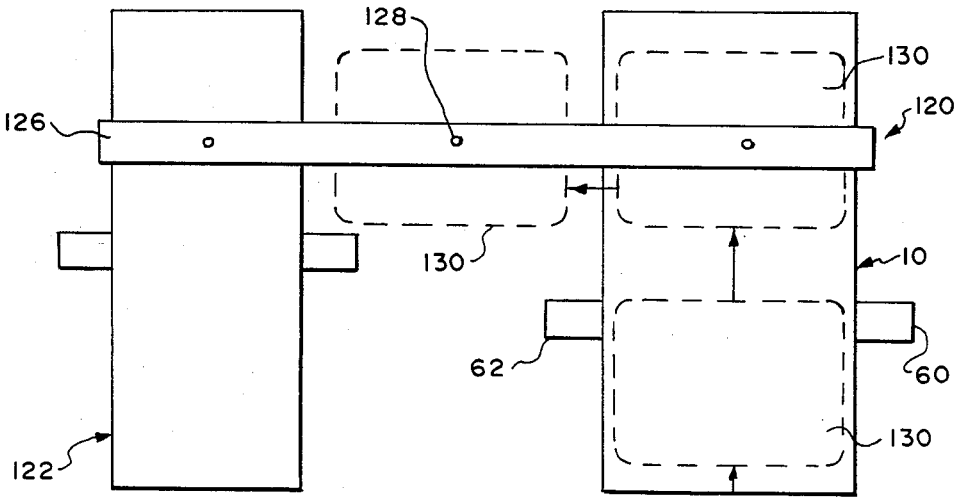
FIGS. 4 and 5 are schematic representations of means for transferring and orienting a mattress innerspring to enable clips to be secured along each of the opposed sides thereof with auxiliary clip wrapping apparatus associated with the apparatus of the present invention.
Figure 5:
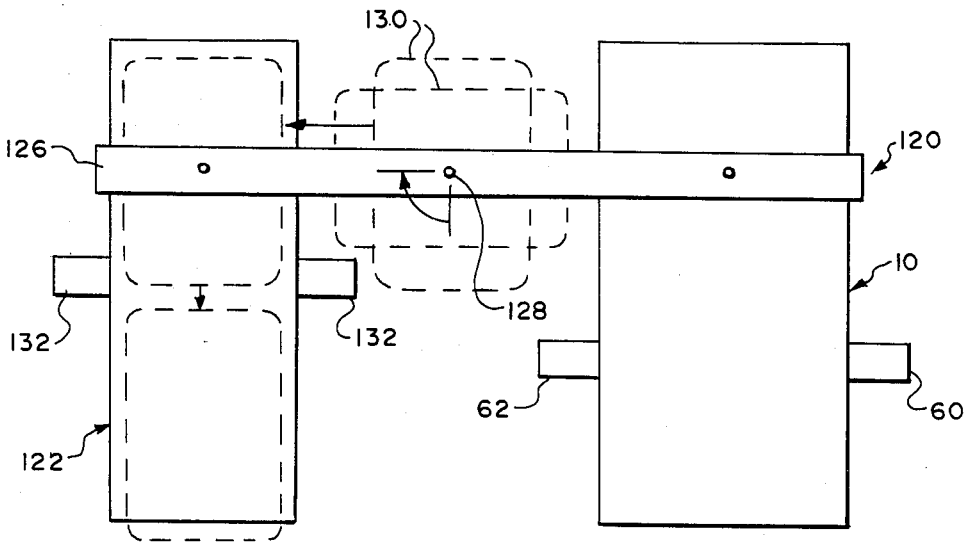

In FIGS. 4 and 5 of the drawings, apparatus is schematically illustrated for transferring and orienting a mattress innerspring on which borderwires have been secured on two of the opposed sides thereof. The apparatus, designated generally by reference numeral 120, advantageously is positioned so that it bridges the clip wrapping apparatus 10, and an auxiliary clip wrapping apparatus 122, the latter being provided with all of the elements comprising the apparatus 10, including conveyor sections, movable guide panels, pairs of clip wrapping tools mounted on movable frames, a pusher, sensors, and control means for all movable parts. The apparatus 120 may be in the form of an overhead crane 126 comprising conveyor means 128 provided with means for grasping and lifting a mattress innerspring 130 off the apparatus 10, and, while en route to the auxiliary clip wrapping apparatus 122, turning the mattress innerspring through an angle of 90° (see FIG. 5) so that when the mattress innerspring 130 is lowered onto the apparatus 122, the sides of the mattress innerspring on which clips are to be secured will be properly oriented with respect to the clip wrapping tools 132 of the apparatus 122. Wrapping of the clips on the mattress innerspring 130 is carried out on the apparatus 122 in the same manner as described in connection with the apparatus 10.

It should be understood that various modifications may be made in the embodiments of the apparatus shown and described herein without deviating from the broader aspects of the same.

What is claimed:

1. Apparatus for automatically securing borderwires on mattress innersprings, comprising: mattress innerspring and borderwire support means on which a mattress innerspring and borderwires are positioned in stacked relation; alignment means associated with the support means for maintaining a mattress innerspring and borderwires in aligned relation to one another on said support means; clip wrapping means positioned adjacent to said support means for simultaneously wrapping a plurality of clips on the borderwires and the coils along the margins of the mattress innerspring to secure the borderwires to the mattress innerspring; adjustable means for selectively moving the alignment means and the clip wrapping means with relation to the support means to enable borderwires to be secured on a mattress innerspring of substantially any dimensions; and control means for sequentially actuating the clip wrapping means whereby the borderwires are successively secured to the coils along the margins of the mattress innerspring.

2. Apparatus according to claim 1 wherein the adjustable alignment means includes guide means positioned on opposite sides of the support means, said guide means being movable transversely with relation to the longitudinal axis of the support means to accommodate the dimensions of the borderwires and mattress innerspring positioned on the support means.

3. Apparatus according to claim 2 wherein the guide means comprises a pair of panels positioned on opposite sides of the support means.

4. Apparatus according to claim 3 wherein a pair of arms are pivotally secured to the panels, and drive means is provided for said arms for moving the panels transversely with relation to the longitudinal axis of the support means to accommodate the dimensions of the borderwires and mattress innerspring positioned on the support means.

5. Apparatus according to claim 4 wherein the drive means includes a power driven screw to which said arms are pivotally secured.

6. Apparatus according to claim 5 wherein said arms are pivotally connected to a pair of travelling nuts carried on the screw.

7. Apparatus according to claim 6 wherein a reversible motor is provided for driving the screw.

8. Apparatus according to claim 1 wherein the clip wrapping means is carried on movable frame means.

9. Apparatus according to claim 8 wherein the movable frame means is provided with wheels, and track means is provided for the wheels.

10. Apparatus according to claim 8 wherein a movable rod is connected to the movable frame means for adjusting the position of the clip wrapping means with relation to borderwires and a mattress innerspring on the support means.

11. Apparatus according to claim 10 wherein the movable rod is connected to a drive screw carried on the support means.

12. Apparatus according to claim 11 wherein the drive screw is powered by a reversible motor.

13. Apparatus according to claim 1 wherein auxiliary apparatus is provided for automatically securing borderwires on mattress innersprings, said auxiliary apparatus comprising borderwire and mattress innerspring support means; clip wrapping means positioned adjacent to said support means for simultaneously wrapping a plurality of clips on the borderwires and the coils along the margins of the mattress innerspring on which clips have not been wrapped by said first mentioned apparatus; and control means for sequentially actuating the clip wrapping means of the said auxiliary apparatus.

14. Apparatus according to claim 13 wherein mattress innerspring transfer means is provided for automatically moving a mattress innerspring from said first mentioned apparatus to said auxiliary apparatus.

15. Apparatus according to claim 14 wherein said transfer means is in the form of an overhead crane provided with means for automatically lifting and conveying a mattress innerspring from said first mentioned apparatus to the auxiliary apparatus.

16. Apparatus according to claim 15 wherein said transfer means is provided with mattress innerspring orienting means for properly aligning the margins of the mattress innerspring along which clips have not been wrapped by said first mentioned apparatus with the clip wrapping means of said auxiliary apparatus.

17. A method of securing borderwires on the coils of a mattress innerspring, comprising: providing borderwire and mattress innerspring support means having adjustable alignment and guide means associated therewith; positioning borderwires and a mattress innerspring in stacked relation on said support means; adjusting said alignment and guide means to one of the dimensions of the borderwires and the mattress innerspring; advancing the stacked borderwires and mattress innerspring along the support means to a clip wrapping station positioned adjacent to the support means; interrupting the advance of the borderwires and the mattress innerspring at the clip wrapping station; simultaneously wrapping a plurality of clips on the borderwires and the coils along said one dimension of the mattress innerspring at the clip wrapping station; and continuing the advance of the borderwires and the mattress innerspring along the support means and the interruption thereof at the clip wrapping station until the borderwires are secured to the coils of the mattress innerspring along said one dimension thereof.

18. A method according to claim 17 wherein the clip wrapping station comprises a plurality of clip wrapping tools adjustably positioned adjacent to the support means, and including the step of adjusting said tools at said station to accommodate said one dimension of the borderwires and the mattress innerspring on the support means.

19. A method according to claim 17 wherein the borderwires and the mattress innerspring are automatically conveyed from the clip wrapping station to an auxiliary clip wrapping station to complete the wrapping of clips on the borderwires and the coils of the mattress innerspring along a second dimension thereof.

20. A method according to claim 19 wherein the borderwires and the mattress innerspring are turned through an angle of 90° as they are being conveyed to said auxiliary clip wrapping station.

* * * * *